United States Patent [19]

Lipinski

[11] 4,138,353

[45] Feb. 6, 1979

[54] CORROSION INHIBITING COMPOSITION AND PROCESS OF USING SAME

[75] Inventor: Richard J. Lipinski, Aurora, Ohio

[73] Assignee: The Mogul Corporation, Chagrin Falls, Ohio

[21] Appl. No.: 783,646

[22] Filed: Apr. 1, 1977

[51] Int. Cl.[2] ..... C23F 11/16; C02B 5/02; C02B 5/06; C23F 11/12

[52] U.S. Cl. ..... 252/181; 106/14.12; 210/59; 210/60; 252/87; 252/387; 252/389 A; 422/12

[58] Field of Search ..... 252/389 A, 387, 87, 252/181; 21/2.5 A, 2.7 A; 210/59, 60; 106/14

[56] References Cited

U.S. PATENT DOCUMENTS

| | | | |
|---|---|---|---|
| 3,110,684 | 11/1963 | Miller | 252/181 |
| 3,723,347 | 3/1973 | Mitchell | 252/389 A |
| 3,891,568 | 6/1975 | Nishio et al. | 252/389 A |
| 3,992,318 | 11/1976 | Gaupp et al. | 252/389 A |

*Primary Examiner*—Benjamin R. Padgett
*Assistant Examiner*—Irwin Gluck
*Attorney, Agent, or Firm*—Fay & Sharpe

[57] ABSTRACT

This invention is directed to a corrosion inhibiting composition and to a process for inhibiting corrosion and the deposition of mineral scale on metal in aqueous systems which comprises adding to the water effective amounts of citric acid and/or the alkali metal salts thereof or combinations of a metal molybdate with citric acid and/or an alkali metal salt thereof and at least one amino methylene phosphonic acid or a derivative thereof.

25 Claims, No Drawings

CORROSION INHIBITING COMPOSITION AND PROCESS OF USING SAME

This invention is directed to a novel corrosion inhibiting composition and to a process for inhibiting corrosion and the deposition of mineral scale on metal in various aqueous systems and more particularly to a process for protecting metal in the presence of water by adding to the water an effective amount of at least one amino methylene phosphonic acid or a derivative thereof in combination with citric acid and/or the alkali metal salts thereof or combinations of a metal molybdate with citric acid and/or on alkali metal salt thereof. In addition, various other corrosion inhibiting compounds such as the inorganic metal oxides and the organic inhibitors such as the azoles may be used in combination with the amino methylene phosphonic acids in accordance with this invention.

BACKGROUND

The use of inorganic corrosion inhibitors, e.g., metal oxides alone and/or in combination with organic inhibitors including organic phosphonic acids have been used in various aqueous systems. It has been found, in accordance with this invention, that certain amino phosphonic acids and its derivatives and particularly the amino methylene phosphonic acids having an increased number of methylene groups in combination with citric acid and/or the alkali metal salts thereof or combinations of a metal molybdate with citric acid and/or its alkali metal salts have improved corrosion inhibition. In addition, the compositions of this invention prevent the deposition of mineral scale normally encountered in aqueous systems.

In general, corrosion is defined as a destructive attack on metal involving an electrochemical or chemical reaction of the metal with its environment. More specifically, an electrochemical attack on a metal surface is the wearing away and undercutting of the metal, which is accelerated after the protective coating, e.g., the oxide film is removed by the corrosive medium. Other types of corrosion include cavitation and erosion wherein addition to an electrochemical reaction the condition of the aqueous systems are such that the continuous flow causes cavities where high pressure areas develop causing pressure and shock resulting in a pitted metal surface. This type of corrosion generally is found in water pumps, propellers, turbine plates, etc. Further, erosion of the metal surface will occur if the medium contains suspended solids which impinge the surface of the metal as the fluid is transported through the pipes thereby removing any protective film and exposing the metal to corrosion.

Presently, many corrosion inhibiting compositions are being used at low levels in an attempt to control corrosion. Often they contain in addition an agent for control of mineral scale formation which has a tendency to increase the rate of corrosion, and therefore stronger corrosion inhibitors at higher concentrations are used in order to obtain satisfactory results. Moreover, the use of some of these inhibitors such as the chromates at higher concentrations is unsatisfactory because of the environmental restrictions. It has been found by utilizing an amino methylene phosphonic acid and particularly an amino methylene phosphonic acid with an increased number of $—CH_2—$ groups, that a lower concentration of inhibitors can be used in combination therewith and in most instances even a weaker inhibitor will provide good results. Thus, the novel compositions of this invention eliminate the need for using inhibitors, e.g., toxic materials at the higher concentrations and provides a corrosion and scale inhibitor which is effective in different aqueous systems.

SUMMARY

To avoid these and related problems, it has been found that certain amino phosphonic acids or the derivatives thereof in combinations with citric acid and/or the alkali metal salts thereof or combinations of a metal molybdate with citric acid and/or in alkali metal salt thereof in effective amounts, e.g., as low as about 3.0 part per million parts by weight of water is capable of protecting various metals and its alloys such as copper, brass, steel, aluminum, iron, etc. The corrosion inhibiting composition, which also helps to minimize mineral deposits generally formed on metal, may be used in various water systems including, for example, air conditioning, steam generating plants, refrigeration systems, heat exchange apparatus, engine jackets and pipes etc. Thus, it is an object of this invention to provide a composition for inhibiting corrosion and to minimize the deposit of mineral scale on metals coming in contact with aqueous systems. It is another object of this invention to provide a process for inhibiting corrosion and mineral deposition on metal in contact with corrosive aqueous systems. It is a further object of this invention to provide a process for inhibiting the corrosion and tarnishing of metals and particularly metals including copper by utilizing a small, but effective amount of an amino methylene phosphonic acid in combination with citric acid and/or an alkali metal salt thereof. These and various other objects will become apparent from a further more detailed description as follows.

DETAILED DESCRIPTION

Specifically, this invention relates to a novel composition for inhibiting corrosion of metal and to prevent the deposition of mineral scale by adding to the water a composition which comprises, parts based on a million parts by weight of water, from about: (a) 0 to 50 parts by weight of an azole, e.g., triazole, up to 100 parts by weight of citric acid or an alkali metal salt thereof, 0 to 100 parts by weight of a metal molybdate; with the proviso that the citric acid (or alkali metal salt) or either the acid or salt alone or in combination with the metal molybdate is present in the water in an amount of at least about 3.0 parts per million with a corrosion inhibiting amount, e.g., at least about 2.0 parts per million of at least one amino methylene phosphonic acid and the derivatives thereof, e.g., water-soluble salts, esters, etc. having the formula:

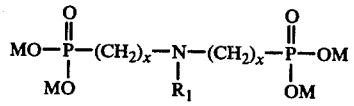

wherein $R_1$ is a monovalent radical selected from the class consisting of the formulae:

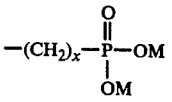

(i)

-continued (ii) $-(CH_2)_y-N(R)_2$ and (iii) $-(CH_2)_y-N(R)-(CH_2)_y-N(R)_2$ wherein R is $$-(CH_2)_x-P(=O)(OM)-OM$$

and y has a value of 1 to 8, x has a value of 1 to 4, and M is a radical selected from the class consisting of hydrogen, an alkali or alkaline earth metal, ammonium, an amino radical and an alkyl or substituted alkyl radical having 1 to 4 carbon atoms.

The derivatives of the phosphonic acid, e.g., salts and esters may be one or the other or a combination thereof provided that the derivative is substantially soluble in water. For purposes of this invention, the amino methylene phosphonic acid and its derivatives may be used in effective amounts, i.e., amounts sufficient to inhibit corrosion and generally ranges from about 2.0 to 50 parts by weight per million parts by weight of water. In addition to the phosphonic acids or its derivatives, citric acid (either alone or with an alkali metal salt thereof) or a metal molybdate must be used in combination therewith in an amount of at least 3.0 parts per million. Citric acid is preferably used in amounts ranging from 3 to 30 and more preferably in amounts ranging from 5 to 15 parts by weight per million parts by weight of water. The alkali metal salts of citric acid are used in similar amounts. The metal molybdates particularly the alkali and alkaline earth metal molybdates, e.g., sodium molybdates, etc. are used in amounts ranging from 3 to 30 and more preferably in amounts ranging from 3 to 15 parts by weight per million parts by weight of water.

The azoles are used in amounts of 0 to 50 parts and particularly the triazoles and preferably used in amounts ranging from 0.1 to 30 parts and more preferably 0.2 to 5 parts by weight per million parts by weight of water and are useful in aqueous systems wherein copper or alloys of copper are present to prevent metal tarnishing. In addition to the amino methylene phosphonic acids, citric acid (or its alkali metal salts) and or with metal molybdates, other known inorganic and organic corrosion inhibitors may be utilized in small, but effective amounts together with various other conventional additives such as the water-soluble polymeric dispersants. These dispersants include, for example, the high molecular weight sulphonated polymers, e.g., sulphonated polystyrene in dispersing amounts, e.g., ranging from 0 to 30 parts per million and preferably in amounts ranging from 0.1 to 10 parts per million per part by weight of water.

It is of particular importance, in accordance with this invention, to recognize that as the molecular weight of the amino methylene phosphonic acid increases, i.e., by increasing the number of methylene groups $-(CH_2)-$ in the molecule, the effectiveness of the phosphonate as a corrosion inhibitor likewise increases. Thus, there is a relationship between the structure of the various amino methylene phosphonates and their effect on corrosion inhibition of metals. It was found that the corrosion rate of a metal decreases as the chain length of the methylene groups increases between the phosphonate groups. For purposes of this invention, the amino methylene phosphonic acids may be characterized by the general formula:

$$MO-P(=O)(MO)-(CH_2)_x-N(R_1)-(CH_2)_x-P(=O)(OM)-OM$$

wherein $R_1$, x and M are as defined hereinabove.

As the number of methylene groups increased, the effectiveness of the amino methylene phosphonate as a corrosion inhibitor likewise improved as illustrated by the data in Table I.

TABLE I

| | | Corrosion Potential (MVS) Initial — Final | Percent Corrosion Inhibitor Open Cell Water |
|---|---|---|---|
| I. | Amino Tri (Methylenephosphonic Acid) $N-(CH_2-PO_3H_2)_3$ | 360 - 450 – | 5.3 |
| II. | Ethylenediamine Tetra(Methylene-Phosphonic Acid) $(H_2O_3P-H_2C)_2>N-(CH_2)_2-N<(CH_2-PO_3H_2)_2$ | 370 - 475 – | 63.3 |
| III. | Diethylenetriamine Penta (Methylene-Phosphonic Acid $2(H_2O_3P-H_2C)->N(H_2C)_2-(N)(CH_2PO_3H_2)-(CH_2)_2-N<(CH_2PO_3H_2)_2$ | 360 - 400 – | 74.2 |
| IV. | Hexamethylenediamine Tetra(Methylene Phosphonic Acid) $2(H_2O_3P-H_2C)->N-(CH_2)_6-N<(CH_2PO_3H_2)_2$ | 370 - 325 + | 90.0 |
| V. | Control | 415 - 685 – | 0.0 |

The above data shows that the percent of corrosion inhibition increases with an increase of methylene groups when comparing the amino tri(methylene phosphonic acid) of formula I with the hexamethylene diamine tetra(methylene phosphonic acid) of formula IV. The corrosion inhibition improved from 53.3% to 90.0% when compared with the control. The corrosion tests were conducted at a pH of 7.5 at temperatures of about 100 ± 2° F. with carbon steel panels. The amino methylene phosphonates were added to the aqueous system at a concentration of about 10 parts per million of the phosphonate per million parts by weight of water.

The following corrosion inhibiting composition was prepared and tested to illustrate that the combination of the amino methylene phosphonate containing an increased number of methylene groups had improved corrosion inhibition in aqueous systems when used in combination with citric acid.

EXAMPLE A

| | Parts by Weight (ppm) million parts of $H_2O$ |
|---|---|
| Polyacrylic Acid (60A%) (2000 Mol Weight) | 26 |
| Citric Acid | 8 |
| Benzotriazole | 1 |
| H.M.W. Sulfonated Polystyrene | 1 |
| Amino Phosphonate | 0.93* |

*Based on the weight of phosphorous in the compound(s).

TABLE II

| Amino-Phosphonate | Corrosion Potentials (MVS) Initial - Final | Percent Corrosion Inhibition Filtered Chagrin Plant Water |
|---|---|---|
| None (Control | 398 - 445 | 81.7 |
| Chemical Formula I | 400 - 380 | 85.0 |
| Chemical Formula II | 440 - 345 | 90.0 |
| Chemical Formula III | 430 - 508 | 71.0 |
| Chemical Formula IV | 425 - 330 | 94.0 |

The data in Table III shows that the combination of citric acid, phosphonate (formula IV) and various concentrations of the metal molybdate increases the percent of corrosion inhibition.

EXAMPLE B

| Cooling Water Test Formulation | Parts by Weight (ppm) million parts of $H_2O$ |
|---|---|
| Polyacrylic Acid (2000 Mol Weight) | 8.0 |
| Citric Acid | 16.0 |
| Formula IV Phosphonate | 6.0 |
| Benzotriazole | 1.0 |
| H.M.W. Sulfonated Polystyrene | 0.5 |
| Sod. Molybdate Dihydrate | Variable |

TABLE III

| Sodium Molybdate Dihydrate (Cont. ppm) | Corrosion Potentials (MVS) Initial - Final | Percent Corrosion Inhibition Filtered Chagrin Plant Water |
|---|---|---|
| 0.0 | 360 - 420 | 83.3 |
| 2.0 | 380 - 390 | 85.0 |
| 4.0 | 370 - 360 | 90.8 |
| 6.0 | 370 - 360 | 90.8 |
| 8.0 | 370 - 320 | 91.7 |
| 10.0 | 400 - 320 | 91.7 |

The corrosion inhibiting composition of Example C was prepared and tested to illustrate that the combination of citric acid and the amino methylene phosphonate (formula IV) resulted in improved corrosion inhibition as the concentration of the citric acid increased.

EXAMPLE C

| Composition | Parts by Weight (ppm) million parts of $H_2O$ |
|---|---|
| Formula IV Phosphonate | 3 |
| Benzotriazole | 1 |
| Citric Acid | Variable |

TABLE IV

| Citric Acid (Conc. ppm) | Corrosion Potentials Initial - Final | Percent Corrosion Inhibition Filtered Chagrin Plant WAter |
|---|---|---|
| 0.0 | 530 - 580 | 60.4 |
| 4.0 | 460 - 525 | 67.9 |
| 8.0 | 415 - 420 | 83.3 |
| 12.0 | 410 - 380 | 84.1 |
| 16.0 | — - 360 | 87.5 |
| 20.0 | 405 - 355 | 87.9 |

The corrosion inhibiting composition of Example D was prepared and tested to illustrate that the combination of a metal molybdate with the phosphonate (formula IV) improved inhibition as the concentration of the phosphonate increased from 2 to 8 parts per million and where the molybdate was omitted, the corrosion inhibition decreased as illustrated by the date in Table V.

EXAMPLE D

| | Parts by Weight (ppm) million parts of $H_2O$ |
|---|---|
| Sodium Molybdate Dihydrate | 20 |
| Benzotriazole | 1 |
| H.M.W. Sulfonated Polystyrene | 0.5 |
| Formula IV Phosphonate | Variable |

TABLE V

| Organo-Phosphonate IV (Conc. ppm) | Corrosion Potentials Initial - Final | Percent Corrosion Inhibition Filtered Chagrin Plant Water |
|---|---|---|
| 0 | 460 - 610 | 33.3 |
| 2 | 380 - 390 | 91.6 |
| 4 | 380 - 390 | 91.6 |
| 6 | 360 - 328 | 95.0 |
| 8 | 370 - 320 | 96.7 |
| 12 (No molybdate) | 460 - 500 | 83.3 |

A basic test composition was prepared as set forth in Example E and tested in combination with various amino methylene phosphonates based on the weight of phosphorous per compound (formula I through IV as illustrated by the data in Table VI.

EXAMPLE E

| Basic Test Composition | PPM |
|---|---|
| Sodium Molybdate Dihydrate | 13.13 |
| Sulfonated Polystyrene | 0.60 |
| Tolyltriazole | 0.75 |

TABLE VI

| Composition | Percent Corrosion Inhibition: Filtered Chagrin Plant Water 19 Hours | Open Cell Water 93 Hours |
|---|---|---|
| Basic Test Composition without Amino Methylene Phosphonate | 27.1 | 15.4 |
| Ex. E + Formula IV | 95.8 | 89 |
| Ex. E + Formula I | 86.7 | 85.5 |
| Ex. E + Formula II | 86.7 | 83.6 |
| Ex. E + Formula III | 90.4 | 84.5 |

It should be noted from the data in Table VI that the test composition, without the amino methylene phosphonate, had low corrosion inhibition (15.4%) whereas the same test composition containing various amino methylene phosphonates gave improved inhibition and particularly where the phosphonate contained an increased number of methylene groups (formula IV).

It was found that the combination of the amino methylene phosphonates of this invention (formula IV) in combination with a metal molybdate gave a synergistic result as illustrated by the data in Table VII.

TABLE VII

| Composition | Conc. in ppm | Percent Corrosion Inhibitor 47 Hours Filtered Chagrin Plant Water | 68 Hours Open Cell Water |
|---|---|---|---|
| Sodium Molybdate Dihydrate + Phosphonate (Formula IV) | 13.13/15 | 94 | 85.5 |
| Sodium Molybdate Dihydrate | 13.13 | 16.7 | 15.4 |
| Phosphonate (Formula IV) | 15.0 | 71.7 | 59.0 |

From the above data, it should be noted that the percent of corrosion inhibition of the amino methylene phosphonate alone was 59% and that the percent of corrosion inhibition of the molybdate alone was 15.4% but that the combination of the metal molybdate and the amino methylene phosphonate improved the corrosion inhibition to 85.5% after 68 hours in open cell water and to 94 after 47 hours in filtered Chagrin plant water.

The compositions were tested for corrosion inhibition by using a three electrode electro-chemical test method. The procedure employed is as follows:

Corrosion potentials of 1010 carbon steel test coupons are monitored against a standard calomel reference electrode in a specific water type at 100 ± 2° F. and a pH range of 7.5 to 8.0. Corrosion currents corresponding to these potentials are measured against a nichrome wire getter electrode with a zero resistance ammeter at polarization potentials of less than 20 millivolts. Using Faradays Law these corrosion currents are converted to total weight loss values. Percent corrosion inhibition levels as shown in the Tables are then calculated using the following expression:

$$\% \text{ Corr. Inhib.} = \frac{\text{Wgt. Loss}(-\text{inhib.}) - \text{Wgt.Loss}(+\text{inhib.})}{\text{Wgt. Loss } (-\text{inhib.})} \times 100$$

This filtered test water employed comprises:

| | |
|---|---|
| TH ($CaCO_3$) | 162 |
| Ca ($CaCO_3$) | 108 |
| Mg ($CaCO_3$) | 54 |
| Cl ($Cl^-$) | 74 |
| PHT, Alk ($CaCO_3$) | 0 |
| M.O. Alk ($CaCO_3$) | 218 |
| pH | 7.7 |
| Spec. Conduc. | 680 |

Open cell water is distilled water containing 50 ppm of active chloride ion.

The compositions of this invention are non-toxic and prevents corrosion of metals in contact with various aqueous sytems. Therefore, the compositions can be substituted for the more toxic materials such as the chromate inhibitors where the toxicity makes them undesirable particularly when disposal of the inhibitors raises a serious water pollution problem.

The compositions are particularly suitable for reducing the corrosion of iron, copper, aluminum, zinc and various alloys of these metals, e.g., steel and other ferrous alloys, such as brass and the like which are generally used in aqueous systems. The amino methylene phosphonic acids and its derivatives include the water-soluble salts such as the alkali and the alkaline earth metal, the amine and lower alkanol amine salts. In addition, the lower esters of these acids can be employed. These esters are derived from the lower molecular weight aliphatic alcohols having 1 to 4 carbon atoms. Mixtures of the acids, salts or esters, etc. can be employed provided they are substantially water-soluble.

In addition to the amino methylene phosphonates and the derivatives in combination with citric acid (or its alkali metal salts) and the metal molybdates, other known organic and/or inorganic corrosion inhibitors may be used in effective amounts. The organic inhibitors may include, for example, the azoles and more particularly the triazoles such as benzotriazole, tolyltriazole and other azoles such as pyrazoles, imidazoles, oxazoles, thiazoles and combinations thereof. The triazoles which may be employed include the water-soluble 1,2,3-triazoles or a substituted 1,2,3-triazole including benzotriazole, tolyltriazole, 4-phenyl-1,2,3-triazole, 1,2-naphthotriazole, 4-nitrobenzotriazole, etc. The pyrazoles include any of the water-soluble compounds such as 3,5-dimethyl pyrazole, 6-nitroindazole, 4-benzyl pyrazole and the like. The imidazoles include the water-soluble compounds such as benzimidazole, 5-methyl benzimidazole, 2-phenyl imidazole, 4-methyl imidazole and the like. The oxazoles include any water-soluble compound such as 2-mercaptoxazole, 2-mercaptobenzoxazole, etc. The thiazoles include 2-mercaptothiazole, 2-mercaptobenzotriaziole, benzothiazole, etc. In combination with the organic corrosion inhibitors various inorganic compounds may be used with the composition of this invention. These include, for example, the nitrates, the nitrites, the silicates, carbonates, oxides etc.

In addition to the corrosion problems, cooling-water systems, for example, have other difficulties depending on the impurities present in the water. If the water is vaporized, scale formation may be a problem. This can be avoided by either softening the water, e.g., ion-exchange treatment or by complexing the scale formers by adding dispersing agents such as lignosulfonates, a polysilicate, a hydrolyzed polyacrylonitrile and more particularly the addition of an acrylic acid compound, e.g., polyacrylic acid or a salt thereof. In addition it may be desirable to add to the water, for example, a biocide to inhibit the growth ot algae and/or dispersants, if needed, such as the sulfonated polystyrenes, the sulfonates, the polyacrylics, e.g., polyacrylamid, and various other water-treating additives generally known in the art.

While this invention has been described by a number of specific embodiments, it is obvious there are variations and modifications which can be made without departing from the spirit and scope of the invention as set forth in the appended claims.

The invention claimed is:

1. A composition for inhibiting mineral scale and corrosion of metal in the presence of water which comprises, parts based on a million parts by weight of water, from about:

(a) 0 to 50 parts by weight of an azole, (b) up to 100 parts by weight of citric acid or its alkali metal salts, (c) 0 to 100 parts by weight of a metal molybdate; wherein either the citric acid, alkali metal salt of citric acid or combinations thereof alone or with the molybdate is present in an amount of at least about 3.0 parts per million, and (d) a corrosion inhibiting amount of at least one amino methylene phosphonic acid and the derivatives thereof having the formula:

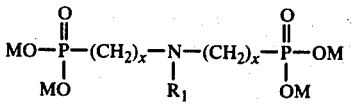

wherein $R_1$ is a monovalent radical selected from the class consisting of the formulae:

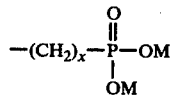

(i)

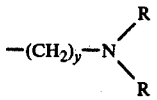

and (ii)

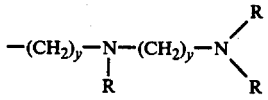

(iii)

wherein R is

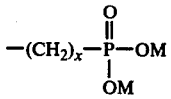

and y has a value of 1 to 8, x has a value of 1 to 4, and M is a radical selected from the class consisting of hydrogen, an alkali or alkaline earth metal, ammonium, an amino radical and an alkyl or substituted alkyl radical having 1 to 4 carbon atoms.

2. The composition of claim 1 further characterized in that the amino methylene phosphonic acid and the derivatives thereof are present in an amount ranging from about 2.0 to 50 parts by weight per million parts by weight of water.

3. The composition of claim 2 further characterized in that citric acid or its alkali metal salt is present in an amount ranging from about 3.0 to 30 parts by weight per million parts by weight of water.

4. The composition of claim 3 further characterized in that the metal molybdate is present in an amount ranging from 3.0 to 30 parts by weight per million parts by weight of water.

5. The composition of claim 3 further characterized in that the azole is a triazole present in an amount ranging from about 0.1 to 30 parts by weight per million parts by weight of water.

6. The composition of claim 3 further characterized in that the phosphonic acid is hexamethylene diamine tetra(methylene phosphonic acid).

7. The composition of claim 3 further characterized in that the metal molybdate is an alkali metal molybdate and the phosphonic acid is hexamethylene diamine tetra(methylene phosphonic acid).

8. The composition of claim 3 further characterized in that the phosphonic acid is an amino tri(methylene phosphonic acid).

9. The composition of claim 3 further characterized in that the phosphonic acid is ethylenediamine tetra(methylene phosphonic acid).

10. The composition of claim 3 further characterized in that the phosphonic acid is diethylenetriamine penta(methylene phosphonic acid).

11. The composition of claim 2 further characterized in that the citric acid or its alkali metal salt is present in an amount ranging from about 3.0 to 30 parts by weight per million parts by weight of water, the molybdate is an alkali metal molybdate present in an amount ranging from about 3.0 to 30 parts by weight per million parts by weight of water and the phosphonic acid is hexamethylene diamine tetra(methylene phosphonic acid).

12. The composition of claim 5 further characterized in that the azole is a triazole present in an amount ranging from about 0.1 to 30 parts by weight per million parts by weight of water and is selected from the class consisting of benzotriazole and tolyltriazole.

13. The composition of claim 1 further characterized in that the citric acid is present in an amount ranging from about 3.0 to 30 parts by weight per million parts by weight of water and the phosphonic acid is hexamethylene diamine tetra(methylenephosphonic acid).

14. The composition of claim 3 further characterized in that the composition comprises a dispersing amount of a water-soluble polymeric dispersing agent.

15. The composition of claim 14 further characterized in that the polymeric dispersing agent is a sulphonated polystyrene.

16. The composition of claim 11 further characterized in that the composition comprises a dispersing amount of a water-soluble polymeric dispersing agent.

17. The composition of claim 3 further characterized in that the composition comprises an inhibiting amount of at least one other inorganic corrosion inhibitor selected from the group consisting of nitrates, nitrites, silicates, carbonates and oxides.

18. A process for inhibiting mineral scale and corrosion of metal in an aqueous system which comprises adding to the water, parts based on a million parts by weight of water, from about:

(a) 0 to 50 parts by weight of an azole, (b) up to 100 parts by weight of citric acid or its alkali metal salt, (c) 0 to 100 parts by weight of a metal molybdate; wherein either the citric acid, alkali metal salt of citric acid or combinations thereof alone or with the molybdate is present in an amount of at least about 3.0 parts per million, and (d) a corrosion inhibiting amount of at least one amino methylene phosphonic acid and the derivatives thereof having the formula:

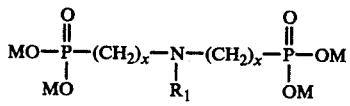

wherein $R_1$ is a monovalent radical selected from the class consisting of the formulae:

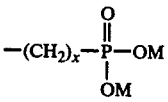

(i)

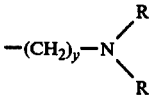

and (ii)

-continued

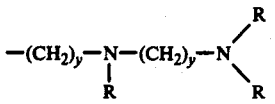

(iii)

wherein R is

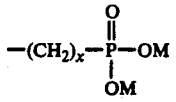

and y has a value of 1 to 8, x has a value of 1 to 4, and M is a radical selected from the class consisting of hydrogen, an alkali or alkaline earth metal, ammonium, an amino radical and an alkyl or substituted alkyl radical of 1 to 4 carbon atoms.

19. The process of claim 18 further characterized in that citric acid or its alkali metal salt is present in an amount ranging from about 3.0 to 30 parts by weight per million parts by weight of water, the molybdate is an alkali metal molybdate present in an amount ranging from about 3.0 to 30 parts by weight per million parts by weight of water and the phosphonic acid is hexamethylene diamine tetra (methylene phosphonic acid) present in an amount ranging from about 2.0 to 50 parts per million by weight.

20. The process of claim 18 further characterized in that the metal molybdate is an alkali metal molybdate present in an amount ranging from about 3.0 to 30 parts by weight per million parts by weight of water and the phosphonic acid is hexamethylene diamine tetra (methylene phosphonic acid).

21. The process of claim 18 further characterized in that citric acid or its alkali metal salt is present in an amount ranging from about 3.0 to 30 parts by weight per million parts by weight of water and the phosphonic acid is hexamethylene diamine tetra (methylene phosphonic acid).

22. The process of claim 18 further characterized in that the azole is present in an amount ranging from about 0.1 to 30 parts by weight per million parts by weight of water and is selected from the class consisting of benzotriazole and tolyltriazole.

23. The process of claim 18 further characterized in that the composition comprises a dispersing amount of a water-soluble polymeric dispersing agent.

24. The process of claim 23 further characterized in that the polymeric dispersing agent is a sulphonated polystyrene.

25. The process of claim 18 further characterized in that an effective amount of at least one other inorganic corrosion inhibitor selected from the group consisting of nitrates, nitrites, silicates, carbonates and oxides is added to the water.

* * * * *

Disclaimer 4,138,353.—*Richard J. Lipinski*, Aurora, Ohio. CORROSION INHIBITING COMPOSITION AND PROCESS OF USING SAME. Patent dated Feb. 6, 1979. Disclaimer filed Aug. 7, 1980, by the assignee, *The Mogul Corporation.*

Hereby enters this disclaimer to claims 1, 2, 3, 6, 7, 8, 9, 10, 13, 18 and 21 of said patent.

[*Official Gazette September 30, 1980.*]